US005336291A

United States Patent [19]

Nukami et al.

[11] Patent Number: 5,336,291

[45] Date of Patent: Aug. 9, 1994

[54] METHOD OF PRODUCTION OF A METALLIC COMPOSITE MATERIAL INCORPORATING METAL CARBIDE PARTICLES DISPERSED THEREIN

[75] Inventors: Tetsuya Nukami, Susono; Tetsuya Suganuma, Nagoya, both of Japan

[73] Assignee: Toyota Jidosha Kabushiki Kaisha, Aichi, Japan

[21] Appl. No.: 84,491

[22] Filed: Jul. 1, 1993

[30] Foreign Application Priority Data

Jul. 2, 1992 [JP] Japan ..... 4-199166

[51] Int. Cl.[5] ..... C22C 1/10; C22C 32/00

[52] U.S. Cl. ..... 75/10.18; 75/10.59; 75/10.65; 75/765; 148/207

[58] Field of Search ..... 75/10.18, 10.59, 10.65, 75/765; 148/207, 523; 420/552

[56] References Cited

U.S. PATENT DOCUMENTS

| | | | |
|---|---|---|---|
| 3,495,019 | 2/1970 | Santi | 75/10.18 |
| 4,710,348 | 12/1987 | Brupbacher et al. | 420/129 |
| 4,748,001 | 5/1988 | Banerji et al. | 420/552 |
| 4,808,372 | 2/1989 | Koczak et al. | 420/552 |

FOREIGN PATENT DOCUMENTS

| | | |
|---|---|---|
| 0258510 | 3/1988 | European Pat. Off. . |
| 0280830 | 9/1988 | European Pat. Off. . |
| 0346771 | 12/1989 | European Pat. Off. . |
| 58-60700 | 4/1983 | Japan . |
| 2-44070 | 2/1990 | Japan . |
| 3-208897 | 9/1991 | Japan . |

*Primary Examiner*—George Wyszomierski
*Attorney, Agent, or Firm*—Finnegan, Henderson, Farabow, Garrett & Dunner

[57] ABSTRACT

In order to produce easily and at low cost a metallic composite material incorporating metal carbide particles dispersed therein such that fine TiC particles and/or ZrC particles are uniformly dispersed in a matrix of Al or Al alloy, first, a pellet (16) is formed from Ti powder and/or Zr powder (10), graphite powder (12) and Al or Al alloy powder (14), then the pellet is infiltrated with molten Al or Al alloy, and thereafter the pellet is heated up to 1000°-1800° C. in an inactive atmosphere, so that TiC particles and/or ZrC particles are generated in the pellet. Then the pellet is dissolved in a molten bath of Al or Al alloy.

5 Claims, 1 Drawing Sheet

METHOD OF PRODUCTION OF A METALLIC COMPOSITE MATERIAL INCORPORATING METAL CARBIDE PARTICLES DISPERSED THEREIN

Background of the Invention

1. Field of the Invention

The present invention relates to a method of production of a metallic composite material, and more particularly to a method of production of a metallic composite material incorporating metal carbide particles dispersed therein.

2. Description of the Prior Art

A method of production of a metallic composite material incorporating metal carbide particles dispersed therein is described, for example, in Japanese Patent Laid-open Publication 63-83239, wherein three kinds of powders of Ti, C and Al are mixed with one another according to a predetermined ratio so as to form a preform of a mixture of those powders, then the preform is heated up to a predetermined temperature in an inactive atmosphere by an electric furnace, thereby producing a material in which particles of TiC are dispersed in a matrix of Al (referred to as "genesis of composite material" hereinunder), and then the genesis of composite material thus obtained is dissolved in a molten matrix of Al alloy.

Such a method is expected to provide a metallic composite material incorporating metal carbide particles dispersed therein in such a type that hard particles of TiC are dispersed in a matrix of Al alloy at a volumetric percentage of the TiC particles in the composite material adjusted to a desired value according to adjustment of the amount of the genesis of composite material to be dissolved in a molten matrix of Al alloy based upon the volumetric percentage of the TiC particles in the genesis of composite material, said volumetric percentage of the TiC particles in the genesis of composite material being detected before it is dissolved in the molten matrix of Al alloy for the production of the metallic composite material incorporating metal carbide particles.

However, although the inventors of the present application had tried to produce the composite material composed of an Al alloy matrix incorporating TiC particles dispersed therein according to the embodiment described in the above-mentioned paten laid-open publication, no such composite material was available that comprises an Al alloy matrix incorporating fine TiC particles dispersed therein.

The reasons why no such composite material was available in good condition as expected appear to have been the following:

(1) Since the genesis of composite material has a perforated structure and has a specific weight less than that of the Al alloy, the genesis of composite material to be dissolved in a molten matrix of Al alloy floats on the surface of a bath of the molten matrix alloy, and therefore the genesis of composite material would not be dissolved into the bath of the molten matrix alloy unless the bath of the molten matrix alloy and the genesis of composite material are mechanically agitated relatively violently in the dissolving process.

(2) Since the genesis of composite material has a perforated structure, the heat conductivity is low, and therefore a substantial time is required before an inside portion of the genesis of composite material thrown into the bath of the molten Al alloy is heated to a temperature enough to melt by a heat conductive contact with the molten Al alloy of the bath thereof.

(3) Since the genesis of composite material has a perforated structure, the molten Al alloy does not well infiltrate into the interstices of the perforated structure as obstructed by the surface tension and the viscosity of the molten Al alloy.

(4) Since the particles of Ti and C in the preform of the mixture of the three kinds of powders are in direct contact with one another, the two elements readily react with one another, and therefore the particles of TiC grow too much, showing a tendency to conglomerate.

(5) Although the preform is heated in an inactive atmosphere, since there remain some oxygen and nitrogen in the preform, $Al_2O_3$ and AlN are generated on the surface of the Al particles, and therefore these oxide and nitride of Al obstruct the melting of the Al powder, while binding the TiC particles together, retarding the dissolution of the genesis of composite material.

SUMMARY OF THE INVENTION

In view of the above-mentioned problems in such a method of production of a metallic composite material incorporating metal carbide particles dispersed therein as described in the afore-mentioned patent laid-open publication, it is the object of the present invention to provide an improved method of production of a metallic composite material incorporating metal carbide particles dispersed therein so that such a metallic composite material is produced to incorporate fine TiC particles and/or ZrC particles uniformly dispersed in the matrix of Al or Al alloy according to easy and efficient processes.

According to the present invention, the above-mentioned object is accomplished by a method of production of a metallic composite material incorporating metal carbide particles dispersed therein, comprising the steps of: forming a preform of a mixture of either or both of Ti powder and Zr powder, graphite powder and Al or Al alloy powder; infiltrating molten Al or Al alloy into said preform; heating said preform infiltrated with Al or Al alloy to 1000°–1800° C. in an inactive atmosphere so as thereby to generate particles of TiC and/or ZrC in said preform; and dissolving said preform including TiC and/or ZrC particles in a molten mass of Al or Al alloy.

According to the method of the present invention, molten Al or Al alloy is infiltrated into a preform of a mixture of Ti powder and/or Zr powder, graphite powder and Al or Al alloy powder before the preform is heated to such a high temperature as to generate TiC and/or ZrC. In this case, Ti and Zr provide a getter effect of absorbing oxygen and nitrogen, said effect being enhanced according to increase of the heating temperature of the preform. Therefore, when the preform is soaked in the molten bath of Al or Al alloy, a vacuum is generated in the interstices of the preform, so that the molten Al or Al alloy is desirably drawn into the interstices of the preform, with no need of a positive pressure being applied to the molten bath of Al or Al alloy, accomplishing a quick infiltration of the molten Al or Al alloy into the interstices of the preform.

According to the method of the present invention, the preform thus having the interstices thereof filled with Al or Al alloy is heated up to 1000°–1800° C. in an inactive atmosphere, so that TiC particles and/or ZrC particles are generated in the preform. In this case, since Ti and/or Zr and C react with one another by diffusion through mediation of Al or Al alloy existing therearound, the size of TiC particles and/or ZrC particles generated is smaller than in the case where the reacting elements are in direct contact with one another, and agglomeration of TiC particles and/or ZrC particles is suppressed. Thus, the TiC particles and/or ZrC particles are generated as fine particles uniformly dispersed in the preform.

Further, according to the method of the present invention, since the preform to be dissolved into a molten matrix bath of Al or Al alloy, i.e. the genesis of composite material, has a solid structure, in contrast to the perforated structure in the conventional method, thereby having a specific weight substantially equal to that of the molten bath of Al or Al alloy and much higher heat conductivity than the conventional perforated preform, the genesis of composite material is readily dissolved into the molten bath of Al or Al alloy with no need of violent mechanical agitation of the bath. Further, since the TiC particles and/or ZrC particles in the genesis of composite material are not mutually bound by $Al_2O_3$ or AlN as in the conventional genesis of composite material, the genesis of composite material is readily disintegrated when soaked in the molten bath of Al or Al alloy, expediting the dissolution of the genesis of composite material in the molten matrix metal.

Although the respective powders used in the method of the present invention may be of any optional particle size, it is desirable that the mean particle diameter of the respective powders is of the order of 0.1–500 microns, in order to produce a possibly uniform composite material.

Further, although the time to heat the preform infiltrated with molten Al or Al alloy at a temperature of 1000°–1800° C. may be determined according to the size, etc. of the preform, it is desirable that the preform is heated to such an elevated temperature at least for 5 seconds, regardless of the size of the preform, so that a core portion of the preform is sufficiently heated to the elevated temperature.

BRIEF DESCRIPTION OF THE DRAWINGS

In the accompanying drawings.

DESCRIPTION OF THE PREFERRED EMBODIMENTS

In the following, the present invention will be described in more detail with respect to several embodiments with reference to the accompanying drawings.

EMBODIMENT 1

FIGS. 1–4 show a series of processes of an embodiment of the method of production of a metallic composite material incorporating metal carbide particles dispersed therein according to the present invention.

Figure 1:
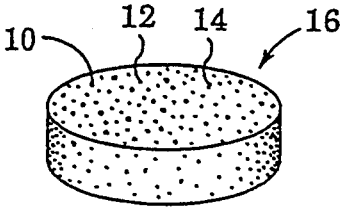
FIGS. 1–4 illustrate a series of processes of an embodiment of the method of production of a metallic composite material incorporating metal carbide particles dispersed therein according to the present invention.

8 g of Ti powder (50 microns mean particle diameter), 2 g of graphite powder (10 microns mean particle diameter) and 10 g of Al powder (100 microns means particle diameter) were uniformly mixed and shaped by a metal mold to a disk-like pellet 16 having a diameter of 30 mm and a height of 10 mm. The pellet had a perforated structure made of Ti powder 10, graphite powder 12 and Al powder 14, as shown in FIG. 1. 12 pieces of such a pellet 16 were prepared.

Figure 2:
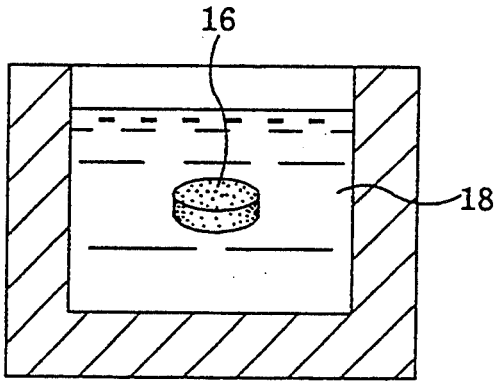

Next, as shown in FIG. 2, each pellet 16 was soaked in a molten bath 18 of pure Al (99.9% purity) maintained at 750° C. under atmospheric pressure for 30 seconds, and after having been taken out from the molten bath, was naturally cooled to a room temperature. One of the thus prepared 12 pellets was cut to inspect the internal structure. As a result, it was confirmed that the interstices of the perforated structure are well infiltrated with pure Al.

Figure 3:
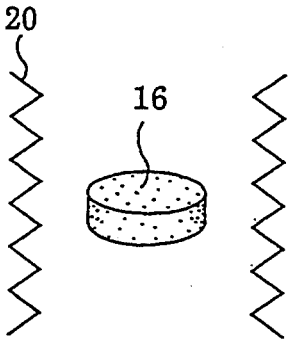

Then, as shown in FIG. 3, each pellet 16 was heated up to 1200° C. by a heater 20 in an atmosphere of argon gas for about 10 seconds, whereby a rapid exothermic reaction occurred. One of the thus prepared 11 pellets was cut to inspect the internal structure. As a result, it was confirmed that a large number of fine particles had educed. The educed particles were identified to be TiC by the X-ray diffraction analysis.

Figure 4:
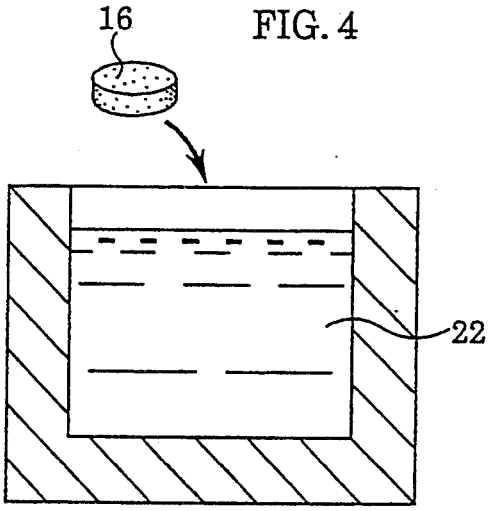

Then, as shown in FIG. 4, each of the remaining 10 pellets 16, i.e., the genesis of complete material, was thrown into a molten bath 22 of pure Al (99.9% purity) maintained at 800° C. by a high frequency melting furnace, and after the lapse of 10 minutes, the molten metal of the bath was cast into a mold cavity having a diameter of 50 mm and a height of 30 mm. The cast metal was naturally close down to room temperature. A solidified body thus obtained was cut along its center line, and the cut surface was polished for inspection by an optical microscope as well as by a scanning electronic microscope. As a result, it was confirmed that a large number of fine TiC particles of diameters of 0.05–1 microns are uniformly dispersed without agglomeration by an area ratio of 20%, showing that the solidified body is a composite material composed of a matrix of pure Al incorporating very fine particles of TiC uniformly dispersed therein.

A bending test piece was cut out from the solidified composite material and was measured of its bending strength at 180° C. As a result, it was confirmed that the composite material has a bending strength of about 15 $kgf/mm^2$ which is about 80% higher than the that of pure Al (about 8 $kgf/mm^2$), showing that the material is reinforced by the dispersion of TiC particles.

For the purpose of comparison, the same pellet made of the above-mentioned three kinds of powders was heated up to 1200° C. by the heater without infiltration of pure Al therein, and the thus prepared pellet was tried to be dissolved into a molten bath of pure Al. However, the pellet floated at the surface of the molten bath of pure Al and was not dissolved therein.

EMBODIMENT 2

The same processes of mixing powders to prepare a powder mixture, shaping the powder mixture to a perforated reform and infiltrating a molten Al alloy into the interstices of the preform were carried out as in Embodiment 1, except that 12 g of Ti powder (50 microns mean particle diameter), 3 g of graphite powder (10 microns mean particle diameter) and 10 g of Al powder (100 microns mean particle diameter) were mixed and shaped to pellets each having a diameter of 30 mm and a height of 12 mm, each such pellet having been soaked in a molten bath of an Al alloy (Al-11 wt%Si) maintained at temperatures ranging from 600° to 1000° C. as stepped by 50° C. As a result, it was confirmed that when the temperature of the molten bath of the Al alloy is higher than 950° C., the pellet is unable to maintain its shape, and therefore a pellet having a desired infiltration of Al alloy is not available.

By using the pellets obtained in the above to have good infiltration of the Al alloy, a composite material was produced in the same manner and according to the same conditions as in Embodiment 1 with respect to the subsequent processes. As a result, it was confirmed that each pellet provides a composite material of good quality composed of a substantially pure Al matrix incorporating fine TiC particles uniformly dispersed therein. Therefore, it would be concluded from this embodiment that the temperature of the molten metal to be infiltrated into the perforated preform should be in a range of 600°-900° C.

The same processes were carried out with an exception that a powder of an Al alloy (Al-11 wt%Si) having 100 microns means particle diameter was used instead of Al powder, and as a result, it was confirmed that composite materials of similarly good quality are available when the temperature of the molten Al alloy infiltrated into the pellets is in the range of 600°-900° C.

EMBODIMENT 3

Composite materials were produced according to the same processes and the same conditions as in Embodiment 1, except that a Ti powder of 100 microns mean particle diameter, a graphite powder of 100 microns mean particle diameter and an Al powder of 150 microns mean particle diameter were used, and the duration of soaking the pellets in the molten bath of pure Al was shortened to 20 seconds. As a result, it was confirmed that the composite materials thus produced have good quality with fine TiC particles uniformly dispersed in the matrix of pure Al.

EMBODIMENT 4

Composite material were produced according to the same processes and the same conditions as in Embodiment 1, except that a Zr powder of 100 mean particle diameter was used instead of the Ti powder. As a result, it was also confirmed that the composite materials thus produced have good quality with fine ZrC particles uniformly dispersed in the matrix of pure Al.

The same processes as in Embodiment 2 were carried out by using the same Zr powder as used above, and it was also confirmed that the temperature of the molten metal to be filtrated into the pellets should desirably be in the range of 600°-900° C.

EMBODIMENT 5

Composite material were produced according to the same processes and the same conditions as in Embodiment 1, except that the Ti powder was replaced by a mixture of a Ti powder having 100 microns mean particle diameter and a Zr powder having 100 microns means particle diameter according to various mixing ratios of the Ti powder to the Zr powder such as 10, 5, 2, 1, 0.5, 0.2 and 0.1 by weight. As a result, it was confirmed that the composite materials thus produced also have good quality with fine TiC particles and ZrC particles uniformly dispersed in the matrix of pure Al.

The same experiments as in Embodiment 2 were carried out by using the same powder mixtures as described above, and it was confirmed that, with respect to all such mixing ratios of powders, the temperature of the molten metal infiltrated into the pellets should also be desirably in the range of 600°-900° C.

EMBODIMENT 6

It was tried to produce composite materials according to the same manners as in Embodiments 1 and 4, except that the molten bath of pure Al in which the pellets were soaked was maintained at 800° C. by a common electric furnace, instead of a high frequency melting furnace. As a result, it was confirmed that the distribution of the TiC particles and the ZrC particles in the matrix is somewhat less uniform than in the case available by Embodiments 1 and 4, although their distribution is much more uniform than in the composite materials produced according to the conventional method.

According to the above results, it is considered that the molten bath of metal in which the perforated preform of a powder mixture is soaked should desirably be agitated to certain extent, and that since it is very difficult to insert an agitation bar into the molten bath of metal maintained at a relatively high temperature, it is desirable that the molten bath of metal is heated by the high frequency method as in Embodiments 1-5 so that an electromagnetic agitation is available.

EMBODIMENT 7

Composite materials were produced according to the same processes and the same conditions as in Embodiment 1, except that the pellets infiltrated with pure Al were heated up to 900°-1800° C. as stepped by 100° C., wherein 1800° C. was an upper limit temperature available by an electric furnace. As a result, it was confirmed that composite materials having high quality including fine TiC particles uniformly dispersed in the matrix of pure Al are available when the pellets were heated up to a temperature of 1000°-1800° C.

Similar results were obtained in various modifications such that the molten metal infiltrated into the pellets was an Al alloy having the composition of Al-11 wt%Si, a Zr powder of 100 microns mean particle diameter was used instead of the Ti powder, or a mixture of a Ti powder of 100 microns mean particle diameter and a Zr powder of 100 microns mean particle diameter by a mixing ration of 1:1 was used instead of the Ti powder.

As is apparent from the foregoing, according to the present invention, it is suppressed that TiC particles and/or Zrc particles generated grow too much or agglomerate, and thereby it is possible to produce a high quality composite material incorporating TiC particles and/or ZrC particles in more fine and uniformly dispersed condition than available according to the conventional method. Further, since the molten Al or Al alloy infiltrates quickly into the preform by the getter effect of Ti and/or Zr during the infiltration process prior to the generation of the TiC particles and/or ZrC particles, and since the genesis of composite material is readily dissolved into the molten bath of Al or Al alloy without violent agitation of the molten bath, the composite material can be produced more easily and at higher efficiency than in the conventional method.

Although the invention has been described with respect to particular embodiments in the above, it would be apparent for those skill in the art that other various embodiments are possible within the scope of the present invention.

For example, although in the above mentioned embodiments the preforms infiltrated with Al or Al alloy had once been cooled down to room temperature before they were heated up to 1000°-1800° C. in an inactive atmosphere, the preforms infiltrated with the molten metal may be heated up to the above-mentioned temperature without being cooled down to room temperature.

Further, although in the above mentioned embodiments the preforms made of three kinds of powders had a shape of disk, the shape of the preforms is not limited to a disk, but may be a rectangular parallelepiped, cube, or any other optional shape.

We claim:

1. A method of production of a metallic composite material incorporating metal carbide particles dispersed therein, comprising the steps of: forming a preform of a mixture of either or both of Ti powder and Zr powder, graphite powder and Al or Al alloy powder; infiltrating first molten Al or Al alloy into said preform at a maximum temperature of 950° C.; heating said preform infiltrated with said first molten Al or Al alloy to 1000°-1800° C. in an inactive atmosphere so as thereby to generate particles of TiC and/or Zrc in said preform; and dissolving said preform including TiC and/or ZrC particles in a second molten mass of Al or Al alloy.

2. A method according to claim 1, wherein the powders for forming the preform have mean particle diameters in a range of 0.1-500 microns.

3. A method according to claim 1, wherein said infiltrating occurs at a temperature in a range of 600°-900° C.

4. A method according to claim 1, wherein said infiltrating takes place by soaking said preform in a bath of molten Al or Al alloy for at least 5 seconds.

5. A method according to claim 1, wherein said dissolving takes place in a bath of molten Al or Al alloy heated by a high frequency furnace.

* * * * *